US008833755B2

(12) United States Patent
Toyooka et al.

(10) Patent No.: US 8,833,755 B2
(45) Date of Patent: Sep. 16, 2014

(54) SHEET FEEDING DEVICE, ELECTROPHOTOGRAPHIC IMAGE FORMING APPARATUS INCORPORATING SAME, AND SHEET SEPARATION METHOD FOR THE APPARATUS

(75) Inventors: Tsugunao Toyooka, Sagamihara (JP); Manabu Nonaka, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 656 days.

(21) Appl. No.: 12/805,173

(22) Filed: Jul. 15, 2010

(65) Prior Publication Data

US 2011/0024971 A1 Feb. 3, 2011

(30) Foreign Application Priority Data

Jul. 28, 2009 (JP) ..... 2009-175297

(51) Int. Cl.

| | |
|---|---|
| ***B65H 3/04*** | (2006.01) |
| ***B65H 3/18*** | (2006.01) |
| ***B65H 3/60*** | (2006.01) |
| ***B65H 3/12*** | (2006.01) |

(52) U.S. Cl.

CPC ..... *B65H 3/18* (2013.01); *B65H 2513/41* (2013.01); *B65H 2301/5322* (2013.01); *B65H 2801/06* (2013.01); *B65H 3/60* (2013.01); *B65H 3/128* (2013.01); *B65H 2511/20* (2013.01); *B65H 3/047* (2013.01); *B65H 2301/512125* (2013.01)

USPC ..... 271/34; 271/18.1; 271/90

(58) Field of Classification Search

USPC ..... 271/161, 42, 34, 18.1, 18.2, 90, 95, 271/104–106, 112, 276, 115, 225, 902; 221/36–43

See application file for complete search history.

(56) References Cited

U.S. PATENT DOCUMENTS 1,715,360 A * 6/1929 Harrold ..... 271/103
3,734,490 A * 5/1973 Parks ..... 271/34

(Continued)

FOREIGN PATENT DOCUMENTS

JP 3159727 2/2001
JP 2001-097580 4/2001

(Continued)

OTHER PUBLICATIONS

Machine translation of the "Detailed Description" section of JP2002-87606.*

(Continued)

*Primary Examiner* — Thomas Morrison

(74) *Attorney, Agent, or Firm* — Harness, Dickey & Pierce, P.L.C.

(57) ABSTRACT

A sheet feeding device incorporable in an image forming apparatus includes a sheet holder to hold multiple sheets including an uppermost sheet placed on the sheet holder, a sheet separating and feeding unit disposed above the sheet holder and movable between a first position and a second position, a controller to control operations performed by the sheet separating and feeding unit moving between the first position and the second position, and a sheet regulator disposed downstream from the sheet holder in the sheet feeding direction to regulate movement of the multiple sheets on the sheet holder in the sheet feeding direction. The controller controls the separating and feeding unit to move the uppermost sheet forward to abut against the sheet regulator and backward to its original position on the sheet holder to separate the uppermost sheet from the multiple sheets on the sheet holder.

2 Claims, 9 Drawing Sheets

(56) References Cited

U.S. PATENT DOCUMENTS

| | | | | | |
|---|---|---|---|---|---|
| 4,428,793 | A | * | 1/1984 | Sato et al. | 156/285 |
| 5,106,260 | A | * | 4/1992 | Obrecht | 414/796.6 |
| 5,219,154 | A | * | 6/1993 | Fukube et al. | 271/18.2 |
| 5,270,563 | A | * | 12/1993 | Mahoney | 177/145 |
| 5,316,282 | A | * | 5/1994 | Fukube et al. | 271/10.07 |
| 5,803,447 | A | * | 9/1998 | Singer et al. | 271/11 |
| 6,082,728 | A | * | 7/2000 | Ubayashi | 271/108 |
| 6,948,710 | B2 | | 9/2005 | Togashi et al. | |
| 7,418,235 | B2 | | 8/2008 | Nonaka et al. | |
| 7,494,120 | B2 | * | 2/2009 | Shimizu et al. | 271/152 |
| 7,515,866 | B2 | | 4/2009 | Togashi et al. | |
| 7,527,257 | B2 | * | 5/2009 | Trilk et al. | 271/104 |
| 7,611,138 | B2 | | 11/2009 | Fujita et al. | |
| 7,635,123 | B2 | | 12/2009 | Watanabe et al. | |
| 7,673,984 | B2 | | 3/2010 | Nonaka | |
| 2003/0155702 | A1 | | 8/2003 | Togashi et al. | |
| 2005/0253323 | A1 | | 11/2005 | Fujita et al. | |
| 2007/0127090 | A1 | | 6/2007 | Nonaka | |
| 2008/0006995 | A1 | | 1/2008 | Nonaka | |
| 2008/0043084 | A1 | * | 2/2008 | Nakashima | 347/104 |

FOREIGN PATENT DOCUMENTS

| | | | |
|---|---|---|---|
| JP | 2001-158538 | | 6/2001 |
| JP | 2002-87606 | * | 3/2002 |
| JP | 2010-58951 | * | 3/2010 |

OTHER PUBLICATIONS

Machine translation of the "Detailed Description" section of JP2010-58951.*

Abstract of Japan Patent Publication No. JP 04-251041 dated Sep. 7, 1992.

* cited by examiner

SHEET FEEDING DEVICE, ELECTROPHOTOGRAPHIC IMAGE FORMING APPARATUS INCORPORATING SAME, AND SHEET SEPARATION METHOD FOR THE APPARATUS

CROSS-REFERENCE TO RELATED APPLICATIONS

The present patent application claims priority pursuant to 35 U.S.C. §119 from Japanese Patent Application No. 2009-175297, filed on Jul. 28, 2009 in the Japan Patent Office, which is hereby incorporated by reference herein in its entirety.

BACKGROUND OF THE INVENTION

1. Field of the Invention

Exemplary embodiments of the present patent application relate to a sheet feeding device, an electrophotographic image forming apparatus incorporating the sheet feeding device, and a sheet separation method for the image forming apparatus, and more particularly, to a sheet feeding device that electrostatically attracts a sheet of a recording medium to an endless belt for separating and feeding the sheet therefrom, an electrophotographic image forming apparatus incorporating the sheet feeding device, and a sheet separation method for the image forming apparatus.

2. Discussion of the Related Art

Related-art image forming apparatuses, such as electrophotographic copiers, facsimile machines, printers, or multifunction printers having at least one of copying, printing, scanning, and facsimile functions, typically form an image on a sheet of recording media according to image data. Thus, for example, a sheet feeding device loads a plurality of sheets and feeds them one by one toward an image forming device. The image forming device forms an image on a sheet supplied from the sheet feeding device.

Sheet feeding devices generally employ an air suction method in which negative pressure is generated by air suction to suction and transport recording media, an electrostatic sheet feed method in which recording media are electrically attracted to a sheet separation member and separated from a stack of recording media one by one, or the like.

As one approach, the sheet feeding device employing the air suction method includes an endless belt formed into a loop having multiple air suction holes formed therein and an air suction duct disposed inside the loop of the endless belt. As a suction force is generated by the air suction duct, an uppermost sheet of a stack of sheets placed on a sheet loading table is suctioned and attracted to the surface of the endless belt.

Generally, a sheet lifting and separating unit is provided together with the suction-type sheet feeding device. The sheet lifting and separating unit sends air to the leading edge of several upper sheets of a stack of sheets placed on the sheet loading table, lifting up the several upper sheets including the uppermost sheet while enabling the sheet lifting and separating unit to separate the uppermost sheet from the other sheets in the stack.

As another approach, the electrostatic sheet feed method is employed in a sheet feeding device that can be incorporated in an electrostatic image forming apparatus. The sheet feeding device includes an endless dielectric belt and a charging member for electrically charging and discharging (more precisely, removing the charge from) the surface of the endless dielectric belt.

The endless dielectric belt that rotates in a sheet feeding direction contacts a top surface of a stack of sheets, and the charging member applies alternating charges (that is, electrical charges of alternating polarity) to the surface of the endless dielectric belt. The charging member performs both a charging operation to form an alternating charge pattern on the surface of the endless dielectric belt and a discharging operation to discharge the surface of the endless dielectric belt.

With the above-described configuration, the electrostatic sheet feeding device charges the surface of the endless dielectric belt to form an electric field that generates a force of attraction to separate the uppermost sheet from the other sheets of the stack of sheets.

However, when separating sheets under high-humidity conditions or with cutting burrs at the edges thereof, the above-described sheet feeding devices cannot reliably separate the uppermost sheet from any subsequent sheets of the stack of sheets, causing multiple-sheet feeding.

To avoid such multiple-sheet feeding, Japanese Patent Application Publication No. 2001-097580 (JP-2001-097580-A) describes a sheet feeding device employing the air suction method that includes a paper warping means having a pair of paper engaging members, a pivoting member, a cam, and a cam shaft. The pair of paper engaging members engages the upper surface of a top sheet of paper across a predetermined gap in a width direction of the sheet stack. One end of the pivoting member is connected to the pair of engaging means. The pivoting member rotates about a supporting bracket provided at the upper part of the pair of paper engaging members. The cam engages the other end of the pivoting member and is rotatably fixed to the cam shaft. The paper warping means causes the pair of paper engaging members to closely contact to or separate from the sheet stack in the width direction, via the pivoting member as the cam shaft rotates.

The sheet feeding device disclosed in JP-2001-097580-A performs a sub-separation operation prior to a sheet separation operation performed by a sheet lifting and separating unit. In the sub-separation operation, the cam shaft is rotated to cause the pair of paper engaging members to approach each other via the cam and the pivoting member in the width direction of the sheet stack. By so doing, the top sheet of paper engaged by the pair of paper engaging members warps between the pair of paper engaging members to curve upwards latitudinally. As a result, a space is formed between the uppermost sheet and any subsequent sheets. By sending air into the space using the sheet lifting and separating unit, the uppermost sheet can be separated from the subsequent sheets.

However, for performing the sub-separation operation prior to the sheet separation operation for an uppermost sheet by the sheet lifting and separating unit, the related-art sheet feeding device disclosed in JP-2001-097580-A must have a sheet warping unit with a complex configuration, which in turn complicates the configuration of the sheet feeding device and increases the cost.

Further, the related-art sheet feeding device cannot feed individual sheets sheet by sheet from a stack of sheets reliably. In the related-art sheet feeding device disclosed in JP-2001-097580-A, the top sheet of paper is attracted to an endless belt having multiple air suction holes formed therein while the top sheet of paper is warped upwardly between the pair of paper engaging members in the width direction of the sheet stack. Therefore, the top sheet of paper is not flat when it is attracted to and contacts the endless belt, meaning that the attraction is unstable. In addition, sheets of paper warp differently, which is likely that the top sheet of paper is attracted to different points on the surface of the endless belt and the sheet of paper may be skewed with respect to the proper sheet feeding direction. If the sheet of paper is fed and conveyed in this condition, the result might be deviation in sheet feeding timing, disrupting the entire image forming process.

SUMMARY OF THE INVENTION

Example aspects of the present patent application have been made in view of the above-described circumstances, and provide a novel sheet feeding device that can separate an uppermost sheet from a stack of sheets to feed the uppermost sheet in a sheet feeding direction without complicating construction of the sheet feeding device and increasing the cost of the sheet feeding device.

Other example aspects of the present patent application provide an improved image forming apparatus that can include the above-described sheet feeding device.

Other example aspects of the present patent application provide a sheet separation method for the above-described image forming apparatus that can include the above-described sheet feeding device.

In one exemplary, embodiment, a sheet feeding device includes a sheet holder, a sheet separating and feeding unit, a controller, and a sheet regulator. The sheet holder holds multiple sheets including an uppermost sheet placed on the sheet holder. The sheet separating and feeding unit is disposed above the sheet holder to perform sheet separation by moving between a first position, at which the sheet separating and feeding unit contacts the uppermost sheet, and a second position, at which the sheet separating and feeding unit is separated from the stack of sheets. The controller controls operations performed by the sheet separating and feeding unit moving between the first position and the second position. The sheet regulator is disposed downstream from the sheet holder in the sheet feeding direction to regulate movement of the multiple sheets on the sheet holder in the sheet feeding direction. The controller controls the sheet separating and feeding unit to move the uppermost sheet forward to abut against the sheet regulator and backward to its original position on the sheet holder to separate the uppermost sheet from the multiple sheets on the sheet holder.

The sheet separating and feeding unit may move vertically between the first position and the second position.

The sheet regulator may be disposed perpendicular to the sheet holder.

The sheet regulator may be disposed at an angle to the sheet holder.

The above-described sheet feeding device may further include a sheet feeding path defined by a first plate and a second plate disposed facing the first place through which the uppermost sheet moved to the second position is conveyed. The sheet feeding path may be disposed higher than the top surface of the multiple sheets placed on the sheet holder. The sheet regulator may be disposed lower than the uppermost sheet moved to the second position by the sheet separating and feeding unit.

The sheet separating and feeding unit may include an endless belt of multilayer construction including a surface formed of a dielectric material, and a charging member to charge the surface of the endless belt. The endless belt may attract the uppermost sheet to separate the uppermost sheet from the multiple sheets placed on the sheet holder.

The sheet separating and feeding unit may include an endless belt with multiple holes formed therein, disposed facing the multiple sheets, and a suction member, disposed on a side of the endless belt away from the multiple sheets, to generate a suction power by sucking air through the multiple holes for attracting the uppermost sheet to the surface of the endless belt. The endless belt may attract the uppermost sheet to separate from the multiple sheets placed on the sheet holder.

In one exemplary embodiment, an image forming apparatus includes the above-described sheet feeding device and an image forming device to form an image on a sheet separated and fed forward by the sheet feeding device.

In one exemplary embodiment, a sheet separation method for an image forming apparatus having a sheet separating and feeding unit, a sheet holder below the sheet separating and feeding unit, and a sheet regulator adjacent to the sheet holder. The sheet separation method includes contacting an uppermost sheet of multiple sheets placed on the sheet holder at a first position, moving the uppermost sheet forward a predetermined distance toward the sheet regulator, moving the uppermost sheet backward to the first position, and lifting up the uppermost sheet to separate from the multiple sheets at a second position.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
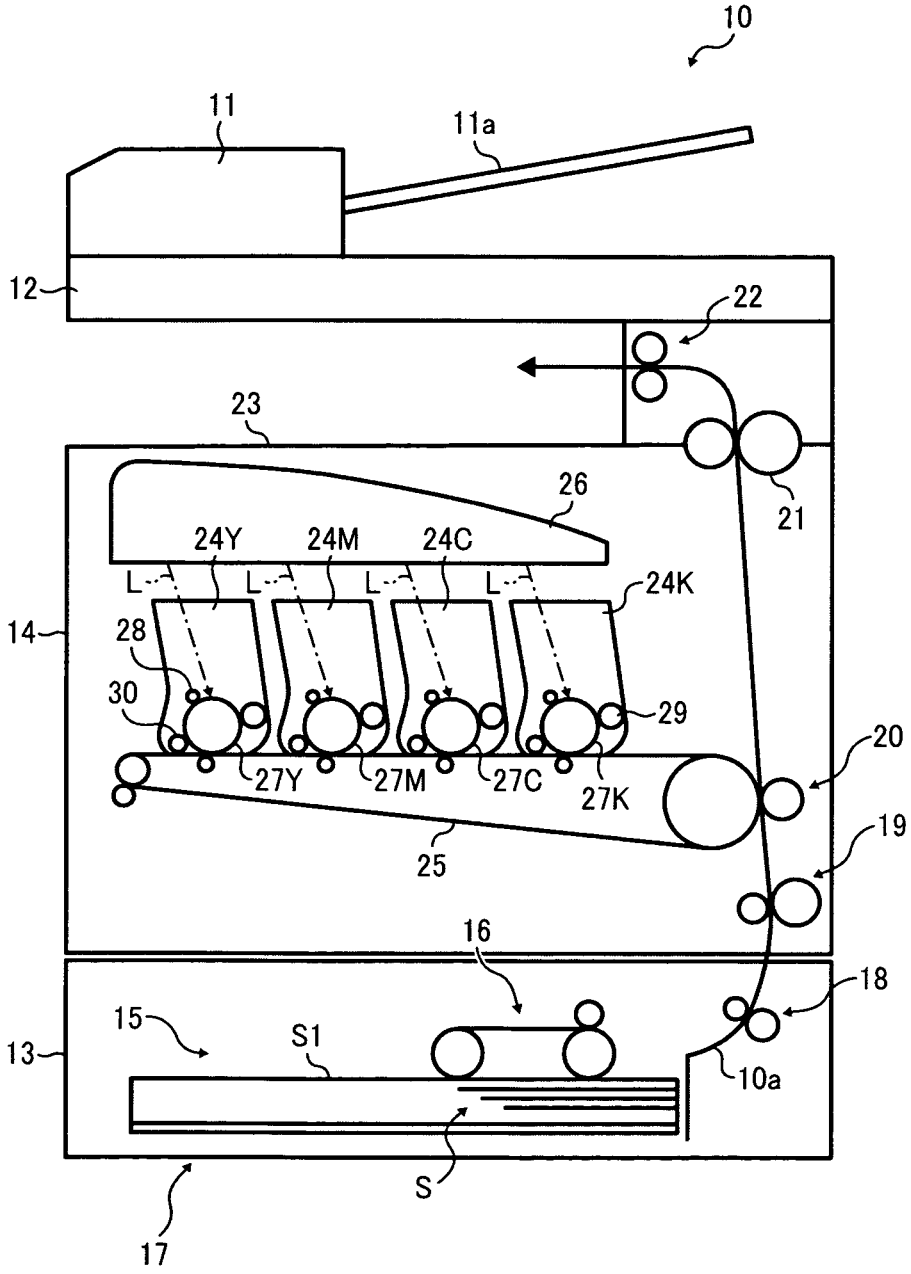
FIG. 1 is a schematic view of an image forming apparatus including a sheet feeding device, according to an exemplary embodiment of the present patent application.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present patent application.

The present patent application includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

FIGS. 1 through 7 are drawings of an electrophotographic image forming apparatus 10 according to an exemplary embodiment of the present patent application, and a sheet feeding device 15 according to an exemplary embodiment of the present patent application.

FIG. 1 is a schematic view of the image forming apparatus 10.

In FIG. 1, the image forming apparatus 10 includes an automatic document feeder (ADF) 11, a document reader 12, a sheet supplying device 13, an image forming device 14, a pair of conveyance rollers 18, a pair of registration rollers 19, a fixing unit 21, a pair of sheet discharging rollers 22, and a sheet discharging tray 23.

As illustrated in FIG. 1, the image forming apparatus 10 may be a copier, a facsimile machine, a printer, a multifunction printer having at least one of copying, printing, scanning, plotter, and facsimile functions, or the like. The image forming apparatus 10 may form an image by an electrophotographic method, an inkjet method, or any other suitable method. According to this exemplary embodiment, the image forming apparatus 10 functions as a copier for forming an image on a recording medium by the electrophotographic method.

The ADF 11 is mounted on the document reader 12. The ADF 11 includes a document sheet tray 11*a* to hold a stack of sheets thereon. The ADF 11 separates each sheet one by one from the stack of sheets on the document sheet tray 11*a* to automatically feed the separated sheet to the document reader 12.

The document reader 12 reads image data of the sheet fed from the ADF 11 on a contact glass mounted thereon.

The sheet supplying device 13 is disposed below the image forming device 14. The sheet supplying device 13 accommodates a stack of sheets S or recording media therein to supply an uppermost sheet S1 separated from the stack of sheets to the image forming device 14.

The image forming device 14 forms an image on the uppermost sheet S1 supplied by the sheet supplying device 13 according to the image data read in the document reader 12.

According to this exemplary embodiment, the image forming device 14 can separate from the sheet supplying device 13 for supplying the uppermost sheet S to the image forming device 14.

The sheet supplying device 13 includes a sheet feeding device 15. The sheet feeding device 15 contacts the uppermost sheet S1 atop the stack of sheets loaded in a sheet carrier 17, described below, that carries the stack of sheets S therein, attracts the uppermost sheet S1, and separates the uppermost sheet S1 from the stack of sheets S.

The uppermost sheet S1 separated by the sheet feeding device 15 travels in a conveyance path 10*a* that passes through a nip formed between the pair of conveyance rollers 18, a nip formed between the pair of registration rollers 19, and a secondary transfer nip formed between the transfer roller 20 and a roller facing the transfer roller 20 with an intermediate transfer belt 25 interposed therebetween.

Through the conveyance path 10*a*, the uppermost sheet S1 is conveyed forward by the pair of conveyance rollers 18 and the pair of registration rollers 19, and receives a toner image formed in the image forming device 14 at the secondary transfer nip of the transfer roller 20. The toner image is then fixed to the uppermost sheet S1 in the fixing unit 21 by application of heat and pressure, and is finally discharged to the sheet discharging tray 23 by the pair of sheet discharging rollers 22.

The image forming device 14 includes four image forming units 24 (specifically, an image forming unit 24Y for forming yellow toner image, an image forming unit 24C for forming cyan toner image, an image forming unit 24M for forming magenta toner image, and an image forming unit 24K for forming black toner image), the intermediate transfer belt 25 that serves as a transfer belt, and an optical writing device 26.

The optical writing device 26 receives color separation image data transmitted from an external device such as a personal computer or a word processor and image data of original documents read by the document reader 12 and converts the image data to a signal for light source driving. Accordingly, the optical writing device 26 drives a semiconductor laser in each laser light source unit and emits light beams L.

The image forming units 24Y, 24C, 24M, and 24K form respective single-color toner images different from each other. The image forming units 24Y, 24C, 24M, and 24K include a photoconductor 27 (specifically, a photoconductor 27Y for carrying yellow toner image thereon, a photoconductor 27C for carrying cyan toner image thereon, a photoconductor 27M for carrying magenta toner image thereon, and a photoconductor 27K for carrying black toner image thereon), and image forming components disposed around the photoconductor 27. The image forming components included in each of the image forming units 24Y, 24C, 24M, and 24K shown in FIG. 1 are a charging unit 28, a developing unit 29, and a cleaning unit 30.

The photoconductor 27 is a cylindrical image carrier that is rotated by a drive source, not illustrated, in a clockwise direction in FIG. 1. The photoconductor 27 has a photoconductive layer as an outer surface thereof. The light beams L or light spots emitted by the optical writing device 26 irradiate the outer surface of the photoconductor 27 to optically write an electrostatic latent image according to image data.

The charging unit 28 is disposed contacting the photoconductor 27 to uniformly charge the outer surface of the photoconductor 27.

The developing unit 29 supplies toner to the outer surface of the photoconductor 27 to, develop the electrostatic latent image into a visible toner image. In this exemplary embodiment, a non-contact type developing unit that does not directly contact the photoconductor 27 is employed.

The cleaning unit 30 is a brush-contact-type unit in which a brush member thereof is disposed slidably contacting the outer surface of the photoconductor 27 to remove residual toner remaining on the outer, surface of the photoconductor 27.

The intermediate transfer belt 25 is an endless belt member including a resin film or a rubber material. The toner image is transferred from the photoconductor 27 onto a surface of the intermediate transfer belt 25 before being further transferred onto the uppermost sheet S1 at the secondary transfer nip formed by the transfer roller 20.

Figure 2:
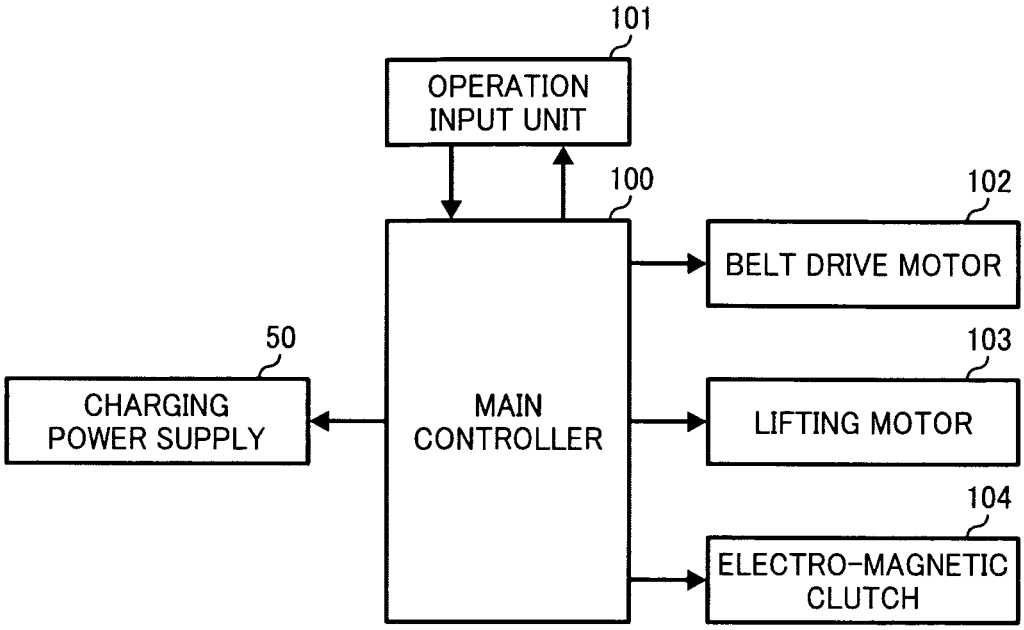
FIG. 2 is a block diagram illustrating a configuration of a control unit of the image forming apparatus shown in FIG. 1.

FIG. 2 is a block diagram illustrating a configuration of a control unit 100 provided to the image forming apparatus 10 according to an exemplary embodiment of the present patent application.

As illustrated in FIG. 2, the control unit 100 is a microcomputer that includes a central processing unit (CPU), a read-only memory (ROM), a random access memory (RAM), an input and output (I/O) interface, and the like.

The control unit 100 shown in FIG. 2 is connected to an operation input unit 101, a belt drive motor 102, a lifting motor 103, an electro-magnetic clutch 104, a charging power supply 50, and other unillustrated various sensors and motors provided to the image forming apparatus 10.

The control unit 100 controls operations of the belt drive motor 102, the lifting motor 103, and the electro-magnetic clutch 104 according to signals inputted from the operation input unit 101, the roller position detection sensor 105 and so forth, thereby causing the sheet feeding device 15 to perform a sheet separating and feeding operation including a sheet sub-separation operation, a sheet separation operation, a sheet feeding operation, and so on. Accordingly, the control unit 100 works as a controller according to an exemplary embodiment of the present patent application.

The operation input unit 101 is provided in the image forming apparatus 10 and includes various keypads such as a numeric keypad and a print start keypad, and various indicators. A user inputs sheet information such as material and size of a sheet directly or selects the sheet information via selection buttons through the operation input unit 101 when feeding the sheet by the sheet feeding device 15. The sheet information inputted or selected by the user is converted to a signal and is outputted to the control unit 100.

The belt drive motor 102 rotates a drive roller 40 included in the sheet supplying device 13 according to the input signal from the control unit 100. The details of the drive roller 40 will be described below.

The lifting motor 103 moves a sheet separation feeder 16, details of which are described below, in a vertical direction via arm members, not illustrated, according to the input signal from the control unit 100. Accordingly, the belt drive motor 102 and the lifting motor 103 serve as a sheet separating and feeding unit according to an exemplary embodiment of the present patent application.

The electro-magnetic clutch 104 is disposed between the belt drive motor 102 and the drive roller 40 and switches between opening (transmitting) and closing (blocking) the power source between the belt drive motor 102 and the drive roller 40 according to the input signal from the control unit 100.

The charging power supply 50 supplies a charging voltage to a charging roller, described below, according to the input signal from the control unit 100.

Next, a detailed description is given of the sheet feeding device 15 according to an exemplary embodiment of the present patent application.

As described above, the sheet feeding device 15 includes the sheet separation feeder 16 and the sheet carrier 17.

Figure 3:
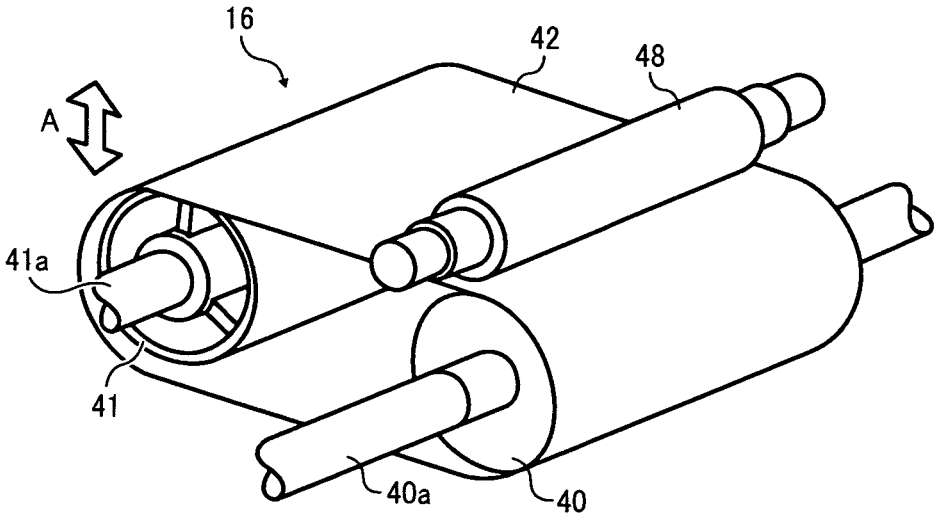
FIG. 3 is a perspective view of a sheet separation feeder, according to the preset patent application, provided in the sheet feeding device of FIG. 1.

FIG. 3 illustrates a perspective view of the sheet separation feeder 16. The sheet separation feeder 16, together with the control unit 100, works as a separating and feeding unit.

As illustrated in FIG. 3, the sheet separation feeder 16 is disposed above the sheet carrier 17 and includes the drive roller 40, the driven roller 41, an endless belt 42, and a charging roller 48. The endless belt 42 includes a dielectric looped over the drive roller 41 that drives the endless belt 42 and the driven roller 41 that is rotated with the drive roller 40. The sheet separation feeder 16 employs an electrostatic sheet feed method in which an uppermost sheet is separated from a stack of sheets by being attracted by the charged endless belt 42. A width, that is, a direction along an axial direction of the sheet separation feeder 16 is narrower or smaller than that of the uppermost sheet S1 and is disposed in the vicinity of the latitudinal center in the width direction of the uppermost sheet S1. Alternatively the width of the sheet separation feeder 16 can be equal to or greater than that of the uppermost sheet S1. Further, two or more sheet separation feeders 16 can be disposed along the width of the uppermost sheet S1 while one sheet separation feeder 16 is provided in the vicinity of the latitudinal center in the width of the uppermost sheet S1 in the sheet supplying device 13 in FIG. 1.

The charging roller 48 that serves as a charging member extends along the width of the endless belt 42. Details of the charging roller 48 will be described below.

The drive roller 40 includes a drive roller shaft 40*a* that is rotatably supported by a housing of the image forming apparatus 10 of FIG. 1. The drive roller 40 is driven by the driving force exerted by the belt drive motor 102 that is controlled according to the input signal from the control unit 100, as illustrated in FIG. 2, to rotate the endless belt 42.

An outer surface of the drive roller 40 includes a conductive rubber layer having a resistivity of about $10^6$ Ω·cm. An inner part of the conductive rubber layer of the drive roller 40 includes a rubber material having a resistivity of about $10^6$ Ω·cm. Both the surface and the inner part of the driven roller 41 include metal. The driven roller 41 rotates with rotation of the endless belt 42 that is driven by the drive roller 40.

Both the surface and the inner part of the driven roller 41 include metal. The driven roller 41 rotates with rotation of the endless belt 42 that is driven by the drive roller 40.

It is to be noted that the drive roller 40 and the driven roller 41 are electrically grounded.

Figure 4A:
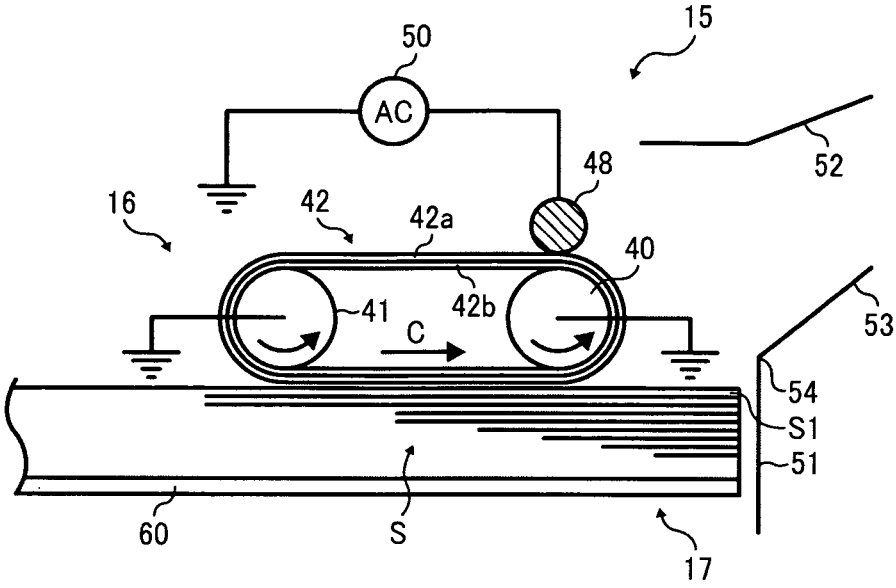
FIG. 4A is a side view of the sheet feeding device shown in FIG. 1, at a sheet attraction position, according to the present patent application.

As illustrated in FIG. 4A, the endless belt 42 is looped over the drive roller 40 and the driven roller 41 and is rotated in the belt rotation direction C following the rotation of the drive roller 40 between the drive roller 40 and the driven roller 41. The endless belt 42 includes a dielectric having a resistivity not smaller than about $10^8$ Ω·cm. For example, the dielectric of the endless belt 42 may be a polyethylene terephthalate film having a thickness of about 100 μm.

The endless belt 42 has a multilayer construction that includes a front layer 42*a* (refer to FIG. 4A) having a resistivity of about $10^8$ Ω·cm or greater and/or a back layer 42*b* (refer to FIG. 4B) having a resistivity of about $10^6$ Ω·cm or smaller to maintain a good charging state. The stack of sheets S is disposed at a position at which the uppermost sheet S1 is attracted by the endless belt 42 over a sufficient area.

As previously noted, the charging roller 48 serving as a charging member extends along the width direction of the endless belt 42 and contacts the endless belt 42 at a point where the endless roller 42 is looped over the drive roller 40.

The charging roller 48 is a charging electrode connected to a charging power supply 50 for generating an alternating current. The charging power supply 50 applies an alternating voltage to the endless belt 42 as needed. The charging roller 48 uses the back layer 42*b* of the endless belt 42 as a grounded opposing electrode. Therefore, the charging roller 48 may contact the front layer 42*a* of the endless belt 42 at any position on the front layer 42*a* of the endless belt 42.

Instead of the charging roller 48, this exemplary embodiment can employ a charging blade as a charging electrode to apply electric charge to the endless belt 42.

Instead of the alternating current, the charging power supply 50 may apply a direct current in which high and low potentials are alternately provided. According to this exemplary embodiment, the charging power supply 50 applies an alternating current having amplitude of about 4 KV to the surface of the endless belt 42, as shown in FIGS. 4A and 4B.

The charging power supply 50 depicted in FIG. 4A applies an alternating voltage via the charging roller 48 to the endless belt 42 rotated by the driving roller 40. As shown in FIG. 4A, the applied alternating voltage is discharged to form a charge pattern in which pitches preferably in a range from about 5 mm to about 15 mm are alternately provided on the front layer 42*a* of the endless belt 42 according to a frequency of the charging power supply 50 for generating the alternating current and a rotation speed (e.g., a circumferential speed) of the endless belt 42.

Figure 4B:
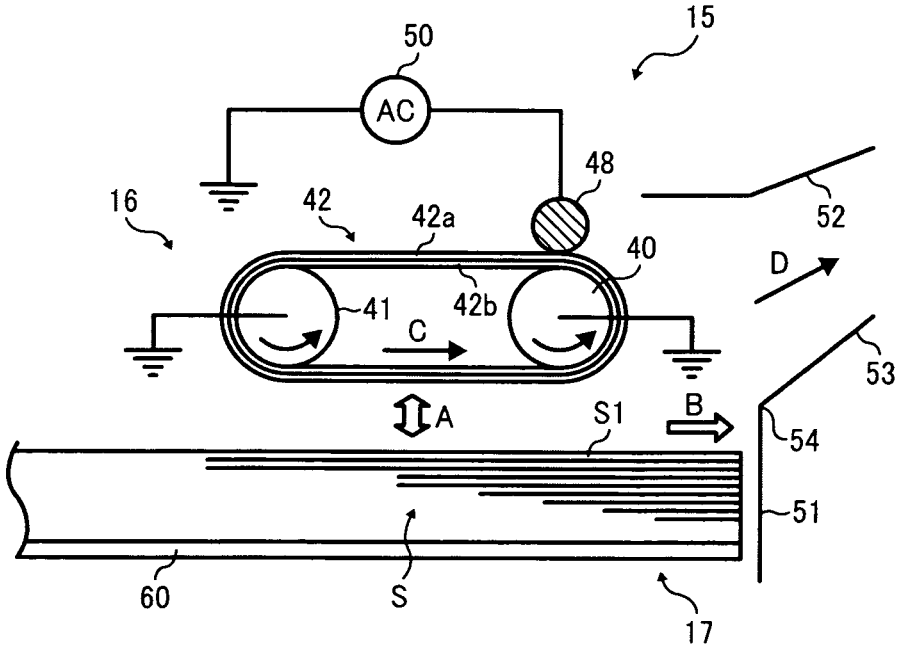
FIG. 4B is a side view of the sheet feeding device shown in FIG. 1, at a sheet separation position, according to the present patent application.

The sheet separation feeder 16 with the above-described configuration is movable in a vertical direction as indicated by arrow "A" in FIG. 4B between a sheet attraction position as illustrated in FIG. 4A and a sheet separation position as illustrated in FIG. 4B via a moving mechanism, not illustrated, while the lower face of the endless belt 42 faces and is generally parallel to the top surface of the stack of sheets S.

The sheet attraction position is defined as a position at which the surface of the endless belt 42 contacts the surface of the uppermost sheet S1 of the stack of sheets S placed on the sheet carrier 17, and the sheet separation position is defined as a position at which the surface of the endless belt 42 is lifted above and separated from the surface of the uppermost sheet S1 of the stack of sheets S.

The moving mechanism includes an arm member and the lifting motor 103 depicted in FIG. 2.

One end of the arm member is attached to supporting members, not illustrated, for regulating a distance between the drive roller 40 and the driven roller 41. The other end of the arm member is attached to the lifting motor 103. As the lifting motor 103 rotates, the arm member transmits a force to move the sheet separation feeder 16 between the sheet attraction position and the sheet separation position while keeping the sheet separation feeder 16 parallel to the top surface of the stack of sheets S.

In this exemplary embodiment, the lifting motor 103 rotates to move the sheet separation feeder 16. However, the lifting motor 103 is not limited to move the sheet separation feeder 16 and, alternatively, a separation and contact solenoid can be used to move up and down the sheet separation feeder 16 up and down.

The sheet carrier 17 includes the bottom plate 60 that serves as a sheet holder to hold the stack of sheets S thereon.

The sheet feeding device 15 further includes a side wall 51, an upper guide plate 52, a lower guide plate 53, and a connecting point 54, as illustrated in FIGS. 4A and 4B. The side wall 51 that serves as a sheet regulator, the upper guide plate 52, and the lower guide plate 53 are provided at a downstream side from the endless belt 42 in the sheet feeding direction D, which is on the right side of FIGS. 4A and 4B.

The side wall 51 regulates the leading edge of sheets in the stack of sheets S carried on the bottom plate 60 of the sheet carrier 17. Especially at the sheet attraction position, the leading edge of the uppermost sheet S1 abuts against the side wall 51 to regulate further conveyance of the uppermost sheet S1 in the sheet feeding direction as indicated by arrow B in FIG. 4A. Therefore, in the sheet attraction position, as the uppermost sheet S1 is conveyed in the sheet feeding direction along with the rotation of the endless belt 42, the leading edge of the uppermost sheet S1 contacts the side wall 51 to warp upwardly at or in the vicinity of the leading edge thereof, as illustrated in FIG. 7B.

The sheet loading position is a position at which the stack of sheets S is placed on the bottom plate 60 before the sub-separation operation is performed, and is a home position to which the warped uppermost sheet S1 returns by moving in an opposite direction to the sheet feeding direction until the uppermost sheet S1 is brought back to its original flat shape.

As described above, the side wall 51 serves as a sheet regulator that is formed by a downstream side face of the sheet carrier 17 in the sheet feeding direction or a separate planar member different from the downstream side face of the sheet carrier 17.

The upper guide plate 52 and the lower guide plate 53 define a part of the conveyance path 10*a* (refer to FIG. 1) toward which a sheet of paper fed by the sheet separation feeder 16 is conveyed. In this exemplary embodiment, the upper guide plate 52 and the lower guide plate 53 define a sheet feeding path of the conveyance path 10*a*.

A point of intersection, i.e., the connecting point 54 of the side wall 51 and the lower guide plate 53 is located higher than the position of the uppermost sheet S1 of the stack of sheets S placed on the bottom plate 60 and lower than the surface of the endless belt 42 facing the stack of sheets 16 when the sheet separation feeder 16 is at the sheet separation position.

That is, the side wall 51 is disposed lower than the uppermost sheet S1 at the sheet separation position moved by the sheet separation feeder 16 and the upper guide plate 52 and the lower guide plate 53 are disposed higher than the top surface of the stack of sheets S placed on the bottom plate 60.

Next, referring to FIGS. 5, 6, and 7A through 7D, a description is given of the sheet separating and feeding operation including the sub-separation operation, the sheet separation operation, and the sheet feeding operation.

Figure 5:
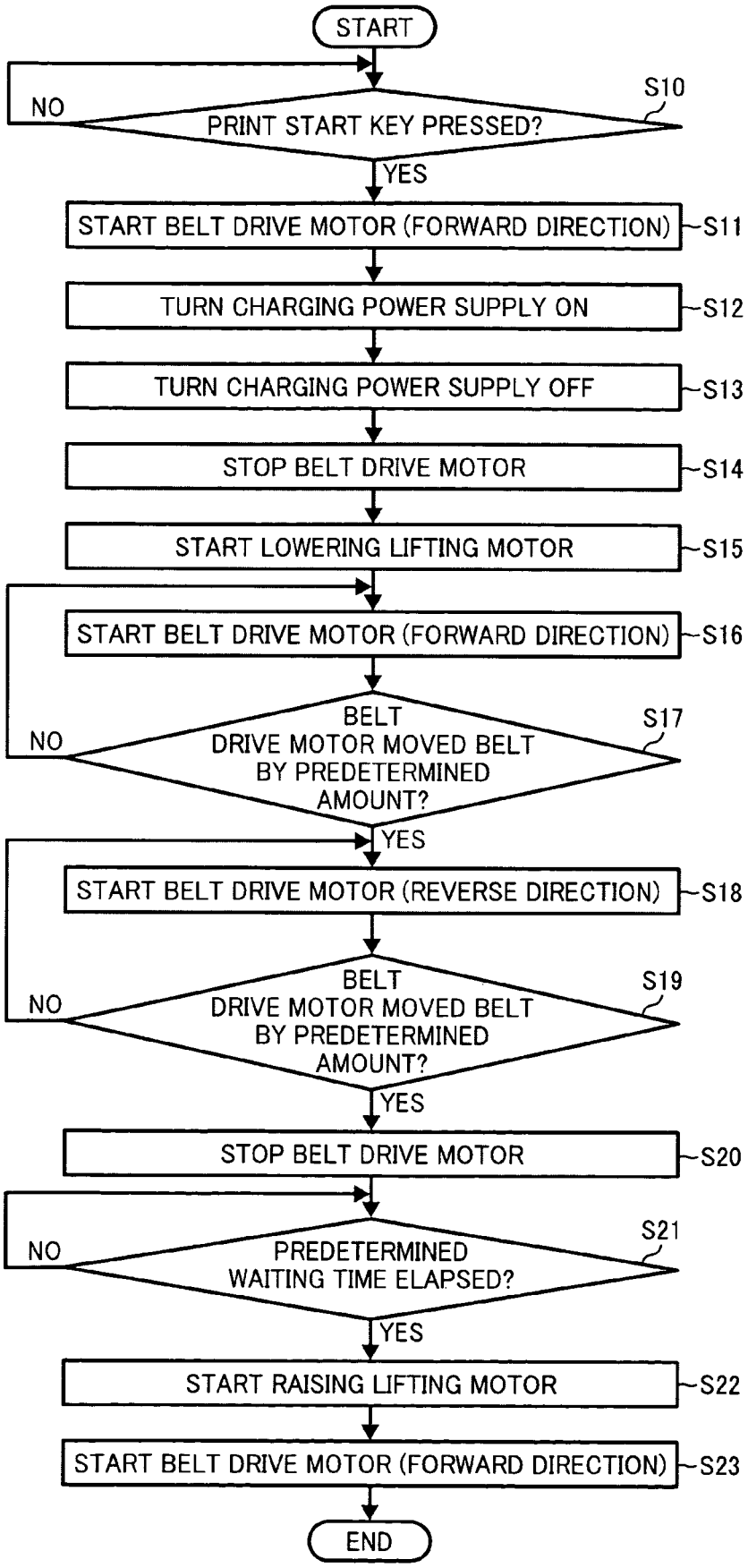
FIG. 5 is a flowchart of a procedure of a sheet separating and feeding operation controlled by the control unit of FIG. 2.

FIG. 5 is a flowchart showing steps in the control procedure of the sheet separating and feeding operation performed in the sheet feeding device 15 by the control unit 100. As shown in the flowchart of FIG. 5, the control unit 100 determines in step S10 whether or not a user has pressed any key on the print start keypad provided on the operation input unit 101.

When the control unit 100 determines that the user has not pressed any key on the print start keypad, the detection result is "NO" and the process repeats the procedure in step S10 until a user presses any key on the print start keypad.

When the control unit 100 determines that the user has pressed the key on the print start keypad, the detection result is "YES" and the process moves to step S11.

In step S11, the control unit 100 transmits a sheet feeding signal to turn on the electro-magnetic clutch 104 and start to drive the belt drive motor 102 in a clockwise direction, which is hereinafter referred to as a "forward direction". According to the start of the belt drive motor 102, the drive roller 40 in the sheet feeding device 15 rotates. Accordingly, the endless belt 42 starts rotating between the drive roller 40 and the driven roller 41.

Figure 6:
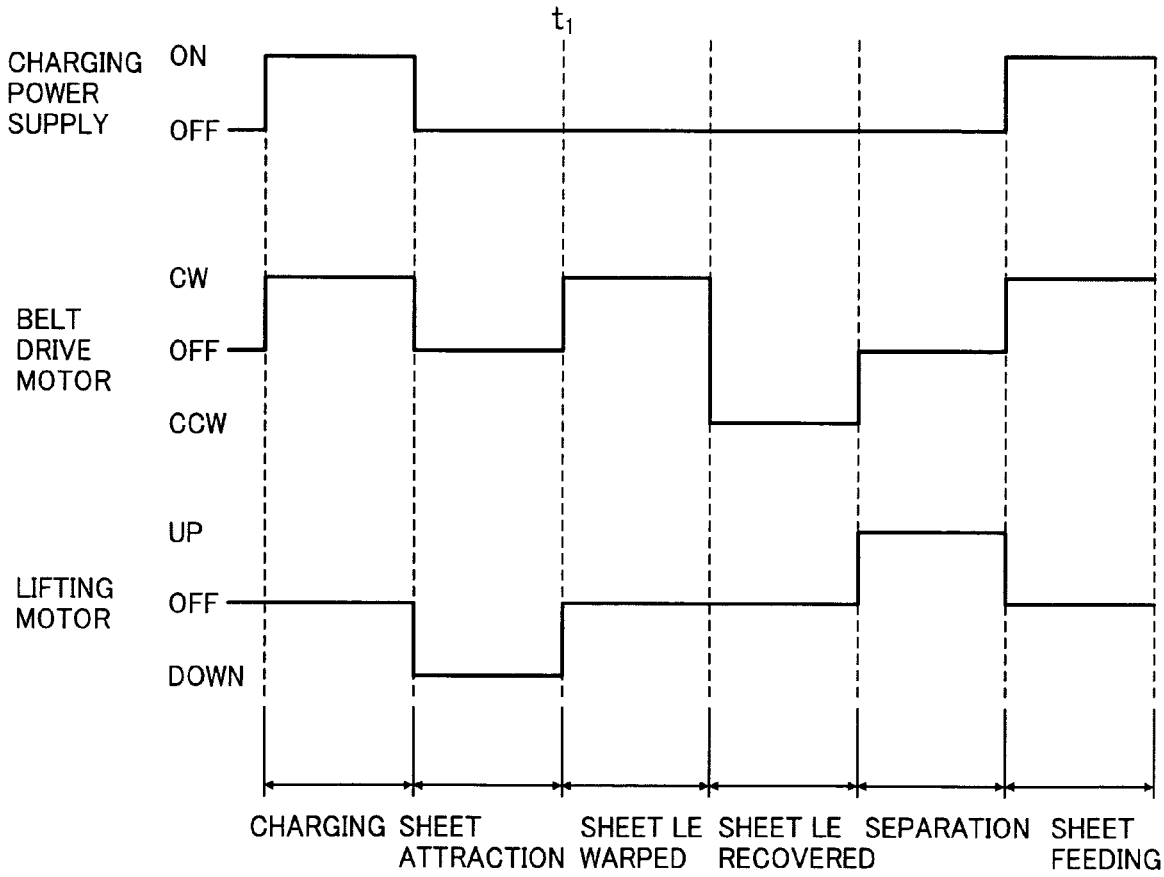
FIG. 6 is a timing chart of a sub-separation operation and a sheet separation operation performed in the sheet feeding device of FIG. 1, according to the present patent application.

After step S11, the control unit 100 turns on the charging power supply 50 in step S12. At this time, as shown in FIG. 6, the belt drive motor 102 rotates in the forward direction while the lifting motor 103 remains unrotated.

With this operation, the charging power supply 50 applies the alternating voltage to the endless belt 42 via the charging roller 48. At this time, the charge pattern having a pitch determined by the frequency of the charging power supply 50 and the rotation speed (e.g., the circumferential speed) of the endless belt 42 is alternately provided on the front layer 42*a* of the endless belt 42. Namely, the endless belt 42 is charged with the alternating voltage.

Then, at completion of charging the endless belt 42 in step S12, the control unit 100 turns off the charging power supply 50 in step S13, and stops rotating the belt drive motor 102 that drives the endless belt 42 in the forward direction in step S14.

Then, in step S15, the control unit 100 starts lowering the lifting motor 103 so that the sheet separation feeder 16 can move from the sheet separation position to the sheet attraction position. At this time, as shown in FIG. 6, the control unit 100 causes the charging power supply 50 and the belt drive motor 102 to turn off and the lifting motor 103 to turn on to move down.

Figure 7A:
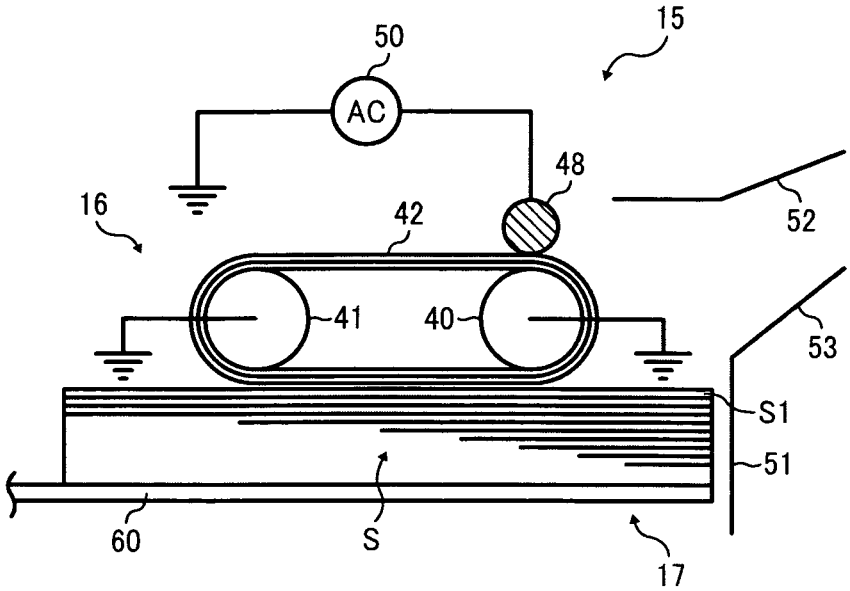
FIG. 7A is a side view of the sheet feeding device when the sheet separation feeder is placed at the sheet attraction position.
Figure 7B:
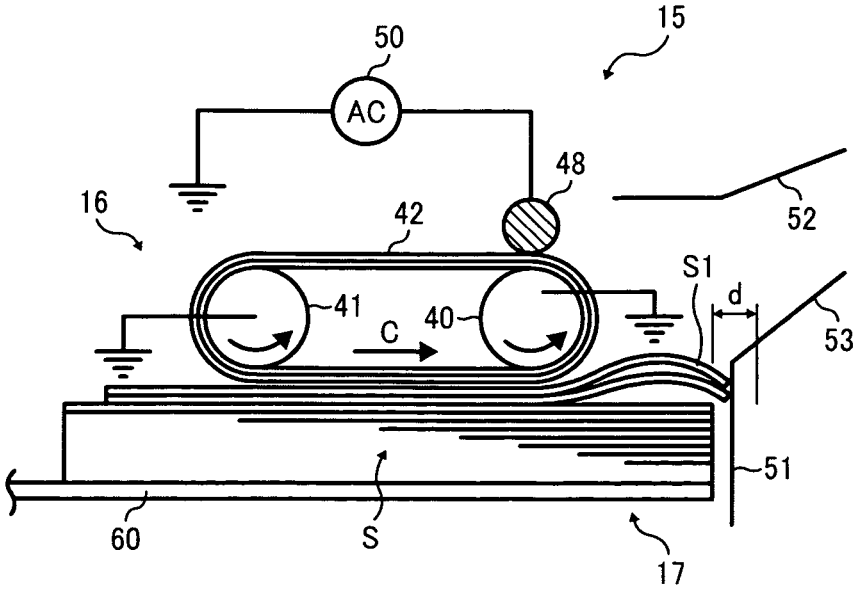
FIG. 7B is a side view of the sheet feeding device with the leading edges of sheets warped.

Consequently, the sheet separation feeder 16 moves from the sheet separation position to the sheet attraction position as shown in FIG. 7A, which can contact the charged surface of the endless belt 42 to the uppermost sheet S1 placed atop the stack of sheets S loaded on the bottom plate 60 of the sheet carrier 17. At this time, in the sheet feeding device 15 as shown in FIG. 7A, the endless belt 42 formed with the positive and negative charge patterns alternatively on the front layer 42*a* contacts the front side (e.g., the upper side) of the uppermost sheet S1 in a predetermined range. A non-uniform electric field formed by the positive and negative charge patterns on the front layer 42*a* of the endless belt 42 applies the Maxwell stress to the dielectric, uppermost sheet S1. Accordingly, the uppermost sheet S1 is attracted to the endless belt 42, and is held and conveyed by the endless belt 42.

Then, the control unit 100 drives the belt drive motor 102 in the forward direction, in step S16. At this time, as the belt drive motor 102 rotates, the drive roller 40 rotates in a direction indicated by an arrow shown in FIG. 7B. Accordingly, the driven roller 41 rotates in a direction indicated by an arrow shown in FIG. 7B, and consequently, the endless belt 42 looped over the drive roller 40 and the driven roller 41 rotates in a direction indicated by an arrow "C" in FIG. 7B. As a result, the endless belt 42 is charged to attract and convey the uppermost sheet S1 in a sheet moving direction (direction "B" in FIG. 4B) by a predetermined distance "d".

When the endless belt 42 conveys the uppermost sheet S1 in the sheet moving direction B by the predetermined distance "d", the leading edge of the uppermost sheet S1 is forced to contact against the side wall 51 to regulate the uppermost sheet S1 from advancing further in the sheet moving direction B. This regulation causes the leading edge of the uppermost sheet S1 and that of any subsequent sheet in the stack of sheets S to bow or warp upwardly.

Generally, the force of attraction exerted due to the charge pattern with respect to sheets affects on the uppermost sheet S1 and any subsequent sheets in the stack of sheets S for a predetermined period of time from the moment the endless belt 42 contacts the stack of sheets S. Accordingly, when the force of attraction is exerted, these subsequent sheets in the stack of sheets S as well as the uppermost sheet S1 are moved in the sheet moving direction B and deformed upwardly. With this deformation of the sheets, space can be formed between the uppermost sheet S1 and several subsequent sheets in the stack of sheets S.

Therefore, in this case, the uppermost sheet S1 that is forcedly abut against the side wall 51 according to an exemplary embodiment can correspond to the upper sheets on the stack of sheets S.

The predetermined distance "d" is an amount of movement of the uppermost sheet S1 in the sheet moving direction B to make the leading edge of the uppermost sheet S1 warp upward and is determined based on an amount of driving force exerted by the belt drive motor 102.

Further, it is preferable that the predetermined distance "d" is set to an appropriate value by adjusting the amount of driving force exerted by the belt drive motor 102 according to data of sheet material and/or size, which are selectively input by a user through direct input or selection buttons of the operation input unit 101.

Next, the control unit 100 determines whether or not the amount of driving force to rotate the belt drive motor 102 in the forward direction has reached its predetermined amount, in step S17.

When the control unit 100 determines that the amount of driving force to rotate the belt drive motor 102 in the forward direction has not yet reached the predetermined amount, the detection result of step S17 is "NO" and the control unit 100 goes back to step S16 to repeat the procedure until the amount of driving force to rotate the belt drive motor 102 in the forward direction reaches the predetermined amount.

Figure 7C:
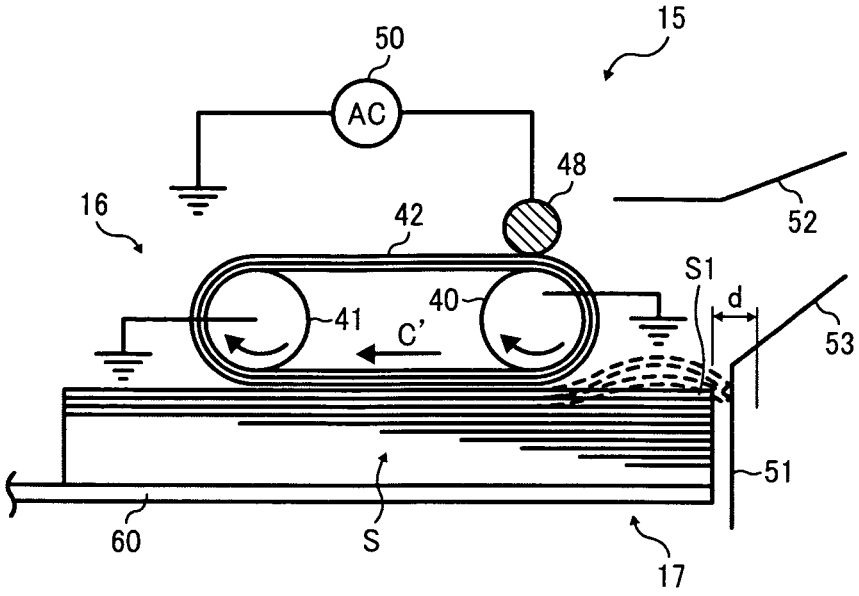
FIG. 7C is a side view of the sheet feeding device when the sheet separation feeder is moved back to the position thereof of FIG. 7A.

By contrast, when the control unit 100 determines that the amount of driving force to rotate the belt drive motor 102 in the forward direction has reached the predetermined amount, the detection result of step S17 is "YES" and the control unit 100 also determines that some upper sheets in the stack of sheets S including the uppermost sheet S1 have warped by a predetermined amount and, as shown in FIG. 6, switches a direction of the belt drive motor 102 from the forward direction to a counterclockwise direction, which is hereinafter referred to as a "reverse direction", in step S18. At this time, as shown in FIG. 7C, the endless belt 42 rotates along with rotation of the drive roller 40 rotated by the belt drive motor 102 in a direction indicated by arrow "C'", which is a direction opposite the direction C shown in FIG. 7B. As a result, the endless belt 42 that is charged to attract and convey these upper sheets in the stack of sheets S including the uppermost sheet S1 moves the upper sheets by a predetermined distance "d" in a direction opposite the sheet moving direction B (as shown in FIG. 4B).

Next, the control unit 100 determines whether or not the amount of driving force to rotate the belt drive motor 102 in the reverse direction has reached the predetermined amount "d", in step S19.

When the control unit 100 determines that the amount of driving force to rotate the belt drive motor 102 in the reverse direction has not yet reached the predetermined amount, the detection result of step S19 is "NO" and the control unit 100 goes back to step S18 to repeat the procedure until the amount of driving force to rotate the belt drive motor 102 in the reverse direction reaches the predetermined amount.

By contrast, when the control unit 100 determines that the amount of driving force to rotate the belt drive motor 102 in the reverse direction has reached the predetermined amount, the detection result of step S19 is "YES" and the control unit 100 also determines that the upper sheets in the stack of sheets S including the uppermost sheet S1 have been returned to its original shape and stops rotating the belt drive motor 102 in the reverse direction, in step S20. With this action, the upper sheets in the stack of sheets S including the uppermost sheet S1 which have been warped upward at and in the vicinity of the leading edge thereof in the sheet moving direction B can be free from the warped shape and brought back to its original flat shape. Further, the upper sheets in the stack of sheets S including the uppermost sheet S1 return to the original position on the bottom plate 60, which is where the upper sheets are placed before being moved by the endless belt 42.

The above-described operations in steps S16 through S20 correspond to the sub-separation operation, which is performed by the sheet separation feeder 16 prior to the sheet separation operation during the sheet separating and feeding operation. Generally the sub-separation operation is performed under high humidity condition where adjacent sheet can adhere to each other easily. Especially coated sheets or art sheets have high smoothness, low air permeability, and high moisture-absorbing, and therefore can get higher adhesion between adjacent sheets under a condition with high humidity, compared to regular sheets. When poor cutting is performed, cutting burr remains to cause the edges of sheets to cling to each other. Accordingly, it is effective to perform the above-described sub-separation operation prior to the sheet separation operation during the sheet separating and feeding operation for preventing poor sheet separation and multiple sheet feeding and facilitating the sheet separation operation regardless of types and/or conditions of sheets.

Next, the control unit 100 determines whether or not a predetermined waiting time has elapsed from a time "t1" shown in FIG. 6, in step S21.

Generally, the force of attraction exerted due to the charge pattern with respect to sheets affects on the uppermost sheet S1 and any subsequent sheets in the stack of sheets S for a predetermined period of time from the moment the endless belt 42 contacts the stack of sheets S. After the predetermined period of time has elapsed, the force of attraction affects on the uppermost sheet S1 only and does not affect any subsequent sheets in the stack of sheets S. Therefore, the uppermost sheet S1 can be separated from any subsequent sheets in the stack of sheets S by waiting for the predetermined time. Accordingly, not the upper sheets in the stack of sheets S including the uppermost sheet S1 but only the uppermost sheet S1 is separated due to the sheet separation operation according to an exemplary embodiment of the present patent application.

When the control unit 100 determines that the predetermined time has not yet elapsed from the time "t1", the detection result of step S21 is "NO" and the control unit 100 repeats the procedure of step S21 until the predetermined time elapses from the time "t1".

Figure 7D:
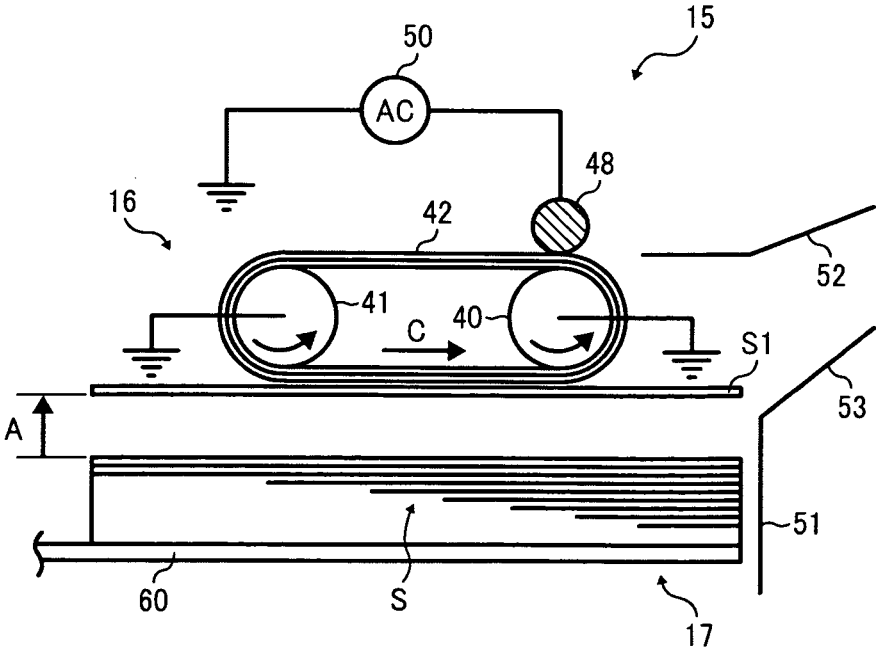
FIG. 7D is a side view of the sheet feeding device when the sheet separation feeder is moved upward to the sheet separation position.

By contrast, when the control unit 100 determines that the predetermined time has elapsed from the time "t1", the detection result of step S21 is "YES" and the control unit 100 also determines that the force of attraction has stopped affecting the upper sheets in the stack of sheets S except for the uppermost sheet S1, and starts raising the lifting motor 103 to elevate the sheet separation feeder 16 up to the sheet separation position, in step S22. At this time, as shown in FIG. 7D, the sheet separation feeder 16 performs the sheet separation operation to move up to the sheet separation position while the endless belt 42 is attracting the uppermost sheet S1.

Whether or not the sheet separation feeder 16 has moved down to the sheet attraction position and whether or not the sheet separation feeder 16 has moved up to the sheet separation position can be determined by the control unit 100 according to the amount of driving force exerted by the lifting motor 103 or according to detection results obtained by a detection sensor that may be disposed close to the sheet attraction position and the sheet separation position.

Next in step S23, the control unit 100 rotates the belt drive motor 102 in the forward direction. At this time, as shown in FIG. 6, the lifting motor 103 is turned off to stop elevation of the sheet separation feeder 16 and the charging power supply 50 is turned on. As a result, the belt drive motor 102 rotates the drive roller 40, as shown in FIG. 7D, so that the endless belt 42 looped around the drive roller 40 and the driven roller 41 rotates in the direction C. According to this action, the uppermost sheet S1 that adheres to the charged endless belt 42 is conveyed in the sheet feeding direction (direction D in FIG. 4B) toward the sheet feeding path between the upper guide plate 52 and the lower guide plate 53.

As described above, in any exemplary embodiments of the present patent application, the sub-separation operation is performed prior to the sheet separation operation during the sheet separating and feeding operation. That is, the sub-separation operation helps separate the uppermost sheet S1 from the stack of sheets S during the sheet separation operation in which the sheet separation feeder 16 separates the uppermost sheet S1 by moving up from the sheet attraction position to the sheet separation position.

In the sub-separation operation, the endless belt 42 of the sheet separation feeder 16 at the sheet attraction position moves the uppermost sheet S1 from the original sheet position of the stack of sheets S on the sheet carrier 17 by the predetermined distance "d" in the sheet moving direction B while attracting the uppermost sheet S1, and then moves the uppermost sheet S1 back to the original sheet position. By so doing, the leading edge of the uppermost sheet S1 in the sheet moving direction B forcedly contacts against the side wall 51 so that the uppermost sheet S1 can be bowed or warped upward in the vicinity of the leading edge of the uppermost sheet S1. Consequently, a layer of air may be formed between the uppermost sheet S1 and any subsequent sheets in the stack of sheets S, and as a result, the adjacent sheets that are adhered or stuck to each other can be separated effectively.

Therefore, according to this exemplary embodiment, the sub-separation operation, which includes a simple configuration and operation in which the uppermost sheet S1 is moved and deformed prior to the sheet separation operation, is performed. Especially even when sheets are accommodated under high humidity and pressed to contact each other due to cutting burr at the edges of sheets, the uppermost sheet S1 can be released from adhesion or press contact to any subsequent sheets in the stack of sheets S. As a result, the sheet separation operation can separate the uppermost sheet S1 from the other sheets of the stack of sheets S reliably without a complexity in configuration and an increase in cost.

Further, in the above-described sub-separation operation according to this exemplary embodiment, the endless belt 42 of the sheet separation feeder 16 attracts the uppermost sheet S1 at the sheet attraction position and advances the uppermost sheet S1 in the sheet moving direction B by the predetermined distance "d" to forcedly contact against the side wall 51 while the endless belt 42 is attracting the uppermost sheet S1. Consequently, only at and in the vicinity of the leading edge of the uppermost sheet S1 in the sheet moving direction B can be warped upward. The endless belt 42 of the sheet separation feeder 16 further rotates in the direction C' so that the uppermost sheet S1 can be returned to the original sheet position on the bottom plate 60. Accordingly, the uppermost sheet S1 that has partly been warped can be returned to its original flat shape. Performing this sub-separation operation can prevent positional error of sheets at the sheet attraction position for adhering to the endless belt 42 and skew of sheets in the sheet feeding direction in the sheet separation operation. As a result, deviation of sheet feeding timings, for example, can be prevented, thereby performing a stable sheet feeding operation per sheet of the stack of sheets S.

Further, according to this exemplary embodiment, the upper guide plate 52 and the lower guide plate 53 are disposed higher than the upper face of the stack of sheets S placed on the bottom plate 60, and the side wall 51 is disposed lower than the uppermost sheet S1 moved to the sheet separation position due to attraction by the endless belt 42 of the sheet separation feeder 16. Therefore, when the sheet separation feeder 16 is at the sheet attraction position, the uppermost sheet S1 can contact against the side wall 51 reliably so as to warp the uppermost sheet S1 upwardly. By contrast, when the sheet separation feeder 16 is at the sheet separation position, the uppermost sheet S1 cannot contact against the side wall 51, thereby feeding the uppermost sheet S1 to the sheet feeding path defined by the upper guide plate 52 and the lower guide plate 53 reliably.

Figure 8:
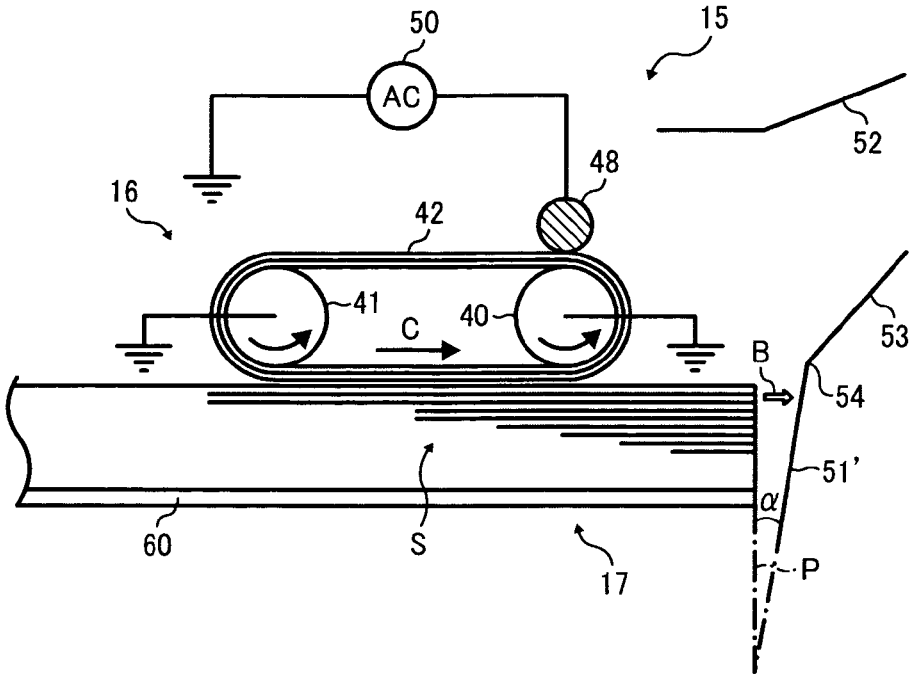
FIG. 8 is a modified example of the sheet feeding device with a slanted side wall according to the present patent application.

In this exemplary embodiment, the side wall 51 is formed to stand in a direction perpendicular to the sheet moving direction (direction B in FIG. 4B), which is a direction where the uppermost sheet S1 is conveyed in the sub-separation operation. However, the side wall 51 is not limited to be formed as described above but can be disposed at an angle with respect to the sheet feeding direction. For example, as illustrated in FIG. 8, a slanted side wall 51' can be disposed at an angle toward downstream of the sheet moving direction B of the uppermost sheet S1 as indicated by arrow B in FIG. 8 in the sub-separation operation. In other words, the slanted side wall 51' is formed with an inclination of a predetermined angle $\alpha$ with respect to a plane P that is perpendicular to the sheet moving direction of the uppermost sheet S1 in the sub-separation operation.

Figure 9:
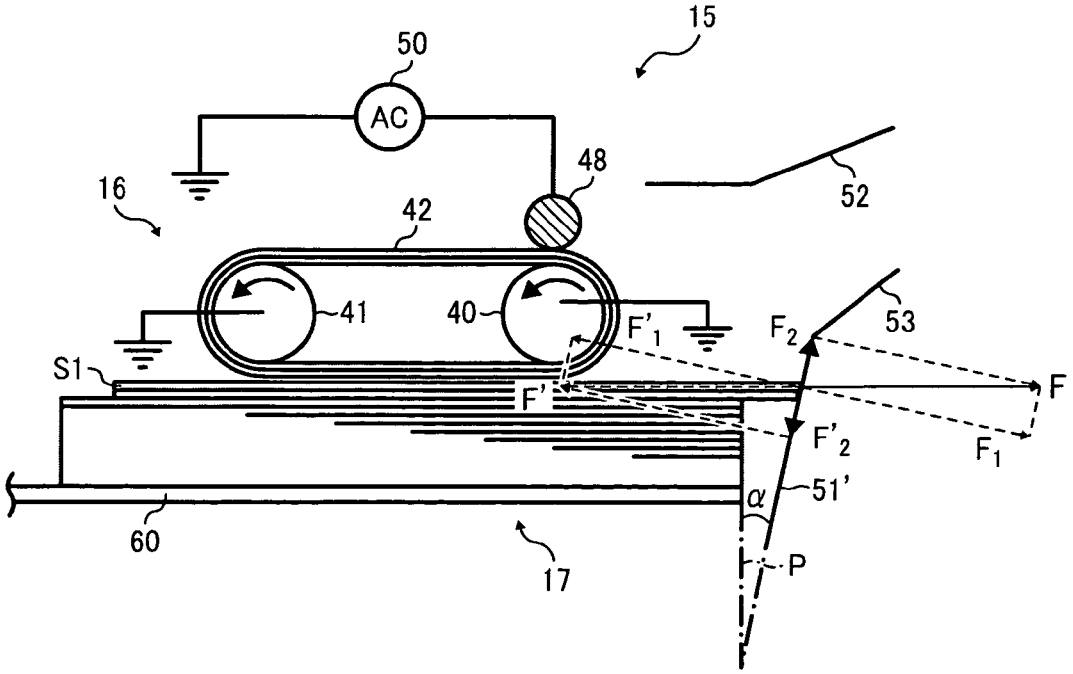
FIG. 9 is a side view of the sheet feeding device shown in FIG. 8, with directions of forces acting at a contact point of the side wall and the sheet according to the present patent application.

In this case, as illustrated in FIG. 9, when the uppermost sheet S1 is moved in the sheet moving direction B and the leading edge thereof contacts against the side wall 51' in the sub-separation operation, the action of the uppermost sheet S1 produces a force F against the slanted side wall 51'. Since the slanted side wall 51' has an inclination of the predetermined angle $\alpha$, a component F1 is produced in a direction perpendicular to the slanted side wall 51' and a component F2 is produced in an upward direction along the surface of the slanted side wall 51'. The component F2 causes the uppermost sheet S1 to separate from the stack of sheets S. Further, a force F' acts on the uppermost sheet S1 in an opposite direction of the force F. As components of the force F', a normal component of reaction F'1 occurs in an opposite direction of the component F1, which is a direction unparallel to the sheet moving direction B shown in FIG. 8 and a normal component of reaction F'2 occurs in an opposite direction of the components F2, which is a downward direction along the surface of the slanted side wall 51'.

Accordingly, in the sub-separation operation, the normal component of reaction F'1 can contribute to warping of the leading edge of the uppermost sheet S1 upwardly at which the uppermost sheet S1 abuts against the slanted side wall 51.

The predetermined angle $\alpha$ is determined as an appropriate angle to warp the leading edge of the uppermost sheet S1 upwardly, according to a coefficient of friction between the leading edge of the uppermost sheet S1 in the sheet feeding direction and the slanted side wall 51' and/or other condition (s).

Further, in this exemplary embodiment, the sheet separation feeder 16 employs the electrostatic sheet feed method but not limited thereto. For example, as illustrated in FIG. 10, an air suction method can be employed to a sheet separation feeder 75 of a sheet feeding device 15A.

Figure 10:
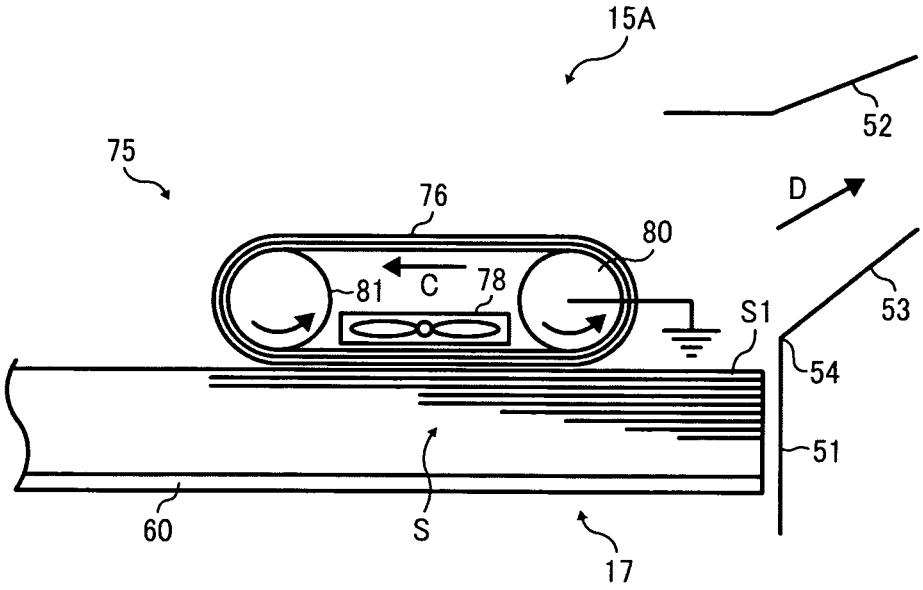
FIG. 10 is a modified example of the sheet feeding device with a fan provided in a loop of an endless belt.

As illustrated in FIG. 10, the sheet separation feeder 75 of the sheet feeding device 15A employs an air suction method includes an endless belt 76, a fan 78, a drive roller 80, and a driven roller 81. The endless belt 76 includes multiple air suction holes, not shown, on a surface thereof. The endless belt 76 is looped around the drive roller 80 and the driven roller 81. The fan 78 is disposed inside the loop of the endless belt 76 and serves as an air suction member to generate a suction power by sucking air through the multiple air suction holes for attracting the uppermost sheet S1 to the surface of the endless belt 76.

The fan 78 regulates a distance between the drive roller 80 and the driven roller 81 and is attached to supporting members, not illustrated, via tightening members. The supporting members are similar to the supporting members 45 of the drive roller 40 and the driven roller 41. The drive roller 80, the driven roller 81, and the endless belt 76 are movable in a vertical direction between the sheet attraction position and the sheet separation position via a moving mechanism that is attached to the supporting members, which is similar to the drive roller 40, the driven roller 41, and the endless belt 42. Therefore, the fan 78 can move in the vertical direction, together with the drive roller 80, the driven roller 81, and the endless belt 76. Consequently, the uppermost sheet S1 sucked by the endless belt 76 can be moved to the sheet separation position to feed and convey in the sheet feeding direction.

Accordingly, the sheet feeding device 15A that includes the sheet separation feeder 75 employing the air suction mechanism can perform the sheet separation operation providing a similar effect to the sheet feeding device 15 that includes the sheet separation feeder 16 employing an electrostatic attraction method.

Further, in this exemplary embodiment, the sheet feeding device 15 performs the sheet separation operation by moving the sheet separation feeder 16 in the vertical direction while staying parallel to the stack of sheets S between the sheet attraction position and the sheet separation position. Alternatively, the sheet feeding device 15 can perform the sheet separation operation with a configuration in which the side wall 51 stops the movement of the uppermost sheet S1 at the sheet attraction position and feeds the uppermost sheet S1 at the sheet separation position. For example, only one of the drive roller 40 and the driven roller 41 winding the endless belt 42 therearound is arranged to be movable in the vertical direction so as to perform the sheet separation operation by turning over sheets.

As described above, the sheet feeding device and the image forming apparatus according to the present patent application can separate an uppermost sheet from a stack of sheets to feed the uppermost sheet in a sheet .feeding direction reliably without complicating construction of the sheet feeding device and increasing the cost of the sheet feeding device. The sheet feeding device and the image forming apparatus incorporating the sheet feeding device can be applied to an electrophotographic copier, a facsimile machine, a printer and the like.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that, the invention may be practiced otherwise than as specifically described herein.

What is claimed is:

1. A sheet feeding device, comprising:

a sheet holder to hold multiple sheets including an uppermost sheet placed on the sheet holder;

a sheet separating and feeding unit disposed above the sheet holder and movable between a first position, at which the sheet separating and feeding unit contacts the uppermost sheet, and a second position, at which the sheet separating and feeding unit is separated from the stack of sheets;

a controller to control operations performed by the sheet separating and feeding unit moving between the first position and the second position; and a sheet regulator disposed downstream from the sheet holder in a sheet feeding direction to regulate movement of the multiple sheets on the sheet holder in the sheet feeding direction, the controller controlling the separating and feeding unit to move the uppermost sheet forward to abut against the sheet regulator and backward to its original position on the sheet holder to separate the uppermost sheet from the multiple sheets on the sheet holder, wherein the entire sheet separating and feeding unit moves vertically between the first position and the second position in a non-pivoting manner, and the controller is configured to control the sheet separating and feeding unit to adhere the uppermost sheet to the sheet separating and feeding unit and to separate the uppermost sheet from the stack of sheets by moving the sheet separating and feeding unit from the first position to the second position with the uppermost sheet adhered to the sheet separating and feeding unit, wherein the sheet separating and feeding unit comprises:

an endless belt of multilayer construction including a surface formed of a dielectric material; and a charging member to charge the surface of the endless belt, wherein the endless belt attracts the uppermost sheet to separate the uppermost sheet from the multiple sheets placed on the sheet holder.

2. A sheet feeding device, comprising:

a sheet holder to hold multiple sheets including an uppermost sheet placed on the sheet holder;

a sheet separating and feeding unit disposed above the sheet holder and movable between a first position, at which the sheet separating and feeding unit contacts the uppermost sheet, and a second position, at which the sheet separating and feeding unit is separated from the stack of sheets;

a controller to control operations performed by the sheet separating and feeding unit moving between the first position and the second position; and a sheet regulator disposed downstream from the sheet holder in a sheet feeding direction to regulate movement of the multiple sheets on the sheet holder in the sheet feeding direction, the controller controlling the separating and feeding unit to move the uppermost sheet forward to abut against the sheet regulator and backward to its original position on the sheet holder to separate the uppermost sheet from the multiple sheets on the sheet holder, wherein the entire sheet separating and feeding unit moves vertically between the first position and the second position in a non-pivoting manner, and the controller is configured to control the sheet separating and feeding unit to adhere the uppermost sheet to the sheet separating and feeding unit and to separate the uppermost sheet from the stack of sheets by moving the sheet separating and feeding unit from the first position to the second position with the uppermost sheet adhered to the sheet separating and feeding unit, wherein the sheet separating and feeding unit comprises:

an endless belt with multiple holes formed therein, disposed facing the multiple sheets; and a suction member, disposed on a side of the endless belt away from the multiple sheets, to generate a suction power by sucking air through the multiple holes for attracting the uppermost sheet to the surface of the endless belt, wherein the endless belt attracts the uppermost sheet to separate from the multiple sheets placed on the sheet holder.

* * * * *